US005552809A

United States Patent [19]

Hosono et al.

[11] Patent Number: 5,552,809

[45] Date of Patent: Sep. 3, 1996

[54] METHOD FOR DRIVING INK JET RECORDING HEAD AND APPARATUS THEREFOR

[75] Inventors: Satoru Hosono; Shoichi Hiraide, both of Nagano, Japan

[73] Assignee: Seiko Epson Corporation, Tokyo, Japan

[21] Appl. No.: 186,378

[22] Filed: Jan. 25, 1994

[30] Foreign Application Priority Data

Jan. 25, 1993 [JP] Japan ..... 5-010216
Dec. 21, 1993 [JP] Japan ..... 5-345355

[51] Int. Cl.[6] ..... B41J 2/045

[52] U.S. Cl. ..... 347/10; 347/15; 347/70

[58] Field of Search ..... 347/9, 10, 15, 347/68–72, 94, 5; 310/316, 317; 358/298

[56] References Cited

U.S. PATENT DOCUMENTS

| | | | |
|---|---|---|---|
| 4,471,363 | 9/1984 | Hanaoka | 347/10 |
| 4,561,025 | 12/1985 | Tsuzuki | 347/15 |
| 5,146,236 | 9/1992 | Hirata et al. | 347/15 X |

FOREIGN PATENT DOCUMENTS

| | | | |
|---|---|---|---|
| 0159188 | 10/1985 | European Pat. Off. . | |
| 541129 | 5/1993 | European Pat. Off. | 347/10 |
| 59-136266 | 8/1984 | Japan | 347/10 |

OTHER PUBLICATIONS

Patent Abstracts Of Japan vol. 14, No. 478 (M–1036) 18 Oct. 1990 (JPA 2 192 947).

Patent Abstracts Of Japan vol. 9, No. 34 (M–357) (1757) 14 Feb. 1985 (JPA 59 176 055).

Patent Abstracts Of Japan vol. 15, No. 452 (M–1180) 18 Nov. 1991 (JPA 03 193 456).

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

An ink jet printing head which prints image data with ink droplets without impairing print quality or causing the recording paper to be excessively wetted. The ink jet recording head includes pressure producing chambers communicating with nozzle openings, and piezoelectric vibrating elements for expanding and contracting the pressure producing chambers. Whether print data is graphics image data or text data is determined by a data judging unit, and as a result of the determination, a time constant of a variable time constant adjusting unit is set to a longer time in the case of printing image data than in the case of printing text data. Also the pressure producing chambers are caused to expand without undergoing damped oscillation for a time which is longer than the natural vibration cycle of the piezoelectric vibrating element.

5 Claims, 9 Drawing Sheets

PRESSURE CHAMBER EXPANSION CYCLE
T1 ($\mu$s)
FIG. 9(g) T1 = 20
FIG. 9(f) T1 = 18
FIG. 9(e) T1 = 16
FIG. 9(d) T1 = 14
FIG. 9(c) T1 = 12
FIG. 9(b) T1 = 10
FIG. 9(a) T1 = 8
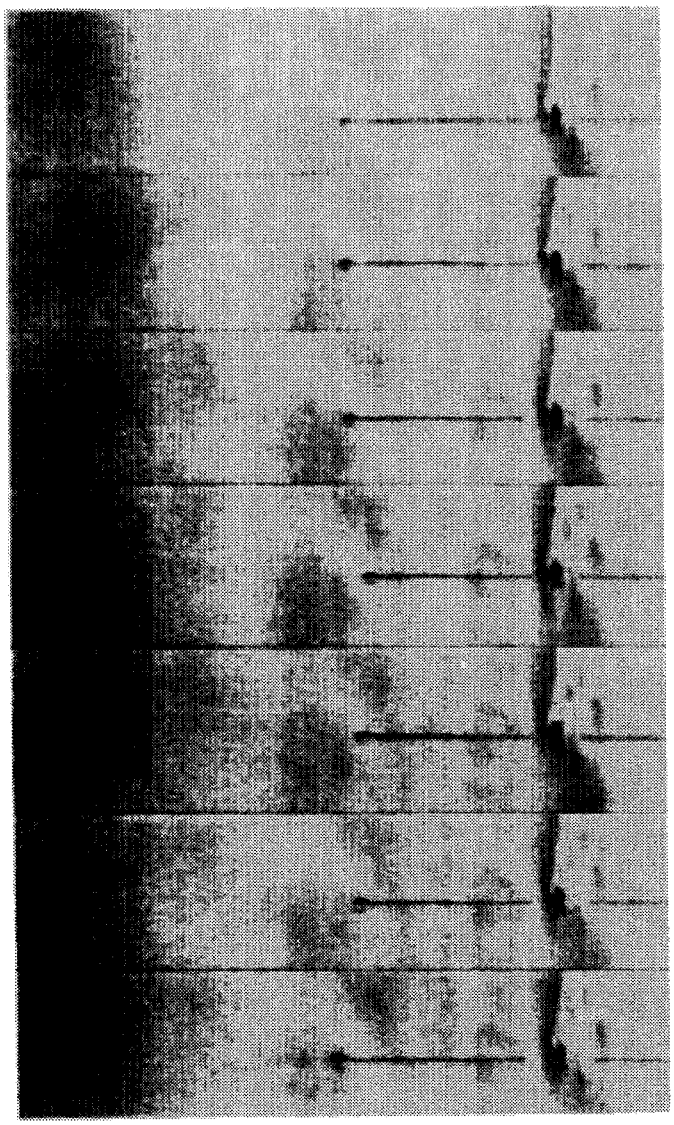

METHOD FOR DRIVING INK JET RECORDING HEAD AND APPARATUS THEREFOR

BACKGROUND OF THE INVENTION

The present invention relates to a recording apparatus for printing print data including image data by jetting an ink droplet from a nozzle opening while displacing a pressure producing chamber using a piezoelectric vibrating element.

As personal computers are gaining in popularity and graphics data processing technology is improving, production of high quality hard copies not only in terms of character data but also for graphics images is becoming increasingly important.

While thermal printers can print such data at a high dot density and tone, these printers entail high operating costs due to expensive ink ribbons the like. To overcome this problem, ink jet printers, whose operating costs are lower, are often used.

However, in the case of printing, for example, a so-called solid image that covers all or a large portion of the surface of the recording paper, a process involving wetting the entire surface of the recording paper with ink must be employed. As a result, the hard copy tends to wrinkle and takes a long time to dry. Further, in the case of printing a color image, the size of the ink droplets ejected from the recording head must be changed to express density gradations.

A technique for changing the size of the ejected ink droplets is described in Japanese Patent Unexamined Publication No. Hei. 2-6137. That is, the size of an ink droplet is changed by adjusting the maximum or minimum voltage applied to a pressure producing element. According to this drive method, ink droplets of different sizes are ejected by changing the volume of the contracted pressure producing chamber at the time of ejecting the ink droplets, and the volume is returned to the initial condition thereafter. As a result, the meniscus and the vibration of the pressure producing element after the ink droplet has been ejected differ from one ejection operation to another, thereby impairing the print quality due to the ejection of tiny ink droplets after the main ink droplet has been ejected.

SUMMARY OF THE INVENTION

The invention has been made in view of the above problems. Accordingly, an object of the invention is to provide a method for driving an ink jet recording head, in which the size of an o ink droplet can be changed by maintaining the ink droplet ejection speed constant with the volume of a contracted pressure producing chamber maintained constant.

Another object of the invention is to provide an apparatus with which to achieve the above object.

To overcome the above problems, the invention provides a method for driving an ink jet recording head having a pressure producing chamber communicating with a nozzle opening and a piezoelectric vibrating element for expanding and contracting the pressure producing chamber, the method comprising the steps of: expanding the pressure producing chamber in an initial condition to a predetermined volume over a first time period which is longer than a natural vibration cycle of the piezoelectric vibrating element and which corresponds to a size of an ink droplet to be ejected; maintaining the pressure producing chamber as expanded for a second predetermined period of time with an expansion start time as a reference; and then contracting the pressure producing chamber to the initial condition over a third predetermined time which is longer than the natural vibration cycle of the piezoelectric vibrating element, so that the ink droplet can be ejected.

When the pressure producing chamber is expanded to the predetermined volume over the first predetermined time, which is longer than the natural vibration cycle of the piezoelectric vibrating element, to supply ink, the meniscus adjacent to the nozzle opening is strongly pulled toward the pressure producing chamber, and then quickly returns to the nozzle opening, inducing vibration while rising up from the nozzle opening. While the cycle of this vibration takes a certain value defined by an ink flow path system, the rising amount depends on the amplitude of the vibration in accordance with the pressure producing chamber expansion speed.

When the pressure producing chamber is caused to contract over the third predetermined time, which is longer than the natural vibration cycle of the piezoelectric vibrating element, at the time the meniscus has returned to the nozzle opening, the size of the ejecting ink droplet is changed because the rising amount of the meniscus depends on the pressure producing chamber expansion speed. On the other hand, the ink droplet ejection speed is maintained constant irrespective of the volume of the ink droplet because such speed depends on the volume velocity at the time of contracting the pressure producing chamber, thereby preventing the ink droplet from being positioned out of place on the recording paper.

BRIEF DESCRIPTION OF THE DRAWINGS

FIG. 7(*b*), the operation of charging and discharging a piezoelectric vibrating element; FIG. 7(*c*), a change in the volume of a pressure producing chamber; and FIG. 7(*d*) the position of a meniscus;

FIGS. 9(*a*) to 9(*g*) are photographs showing an ink droplet, the photographs being taken while a pressure producing chamber expanding time is being changed every predetermined interval from an expansion start time;

DESCRIPTION OF THE PREFERRED EMBODIMENTS

Figure 1:
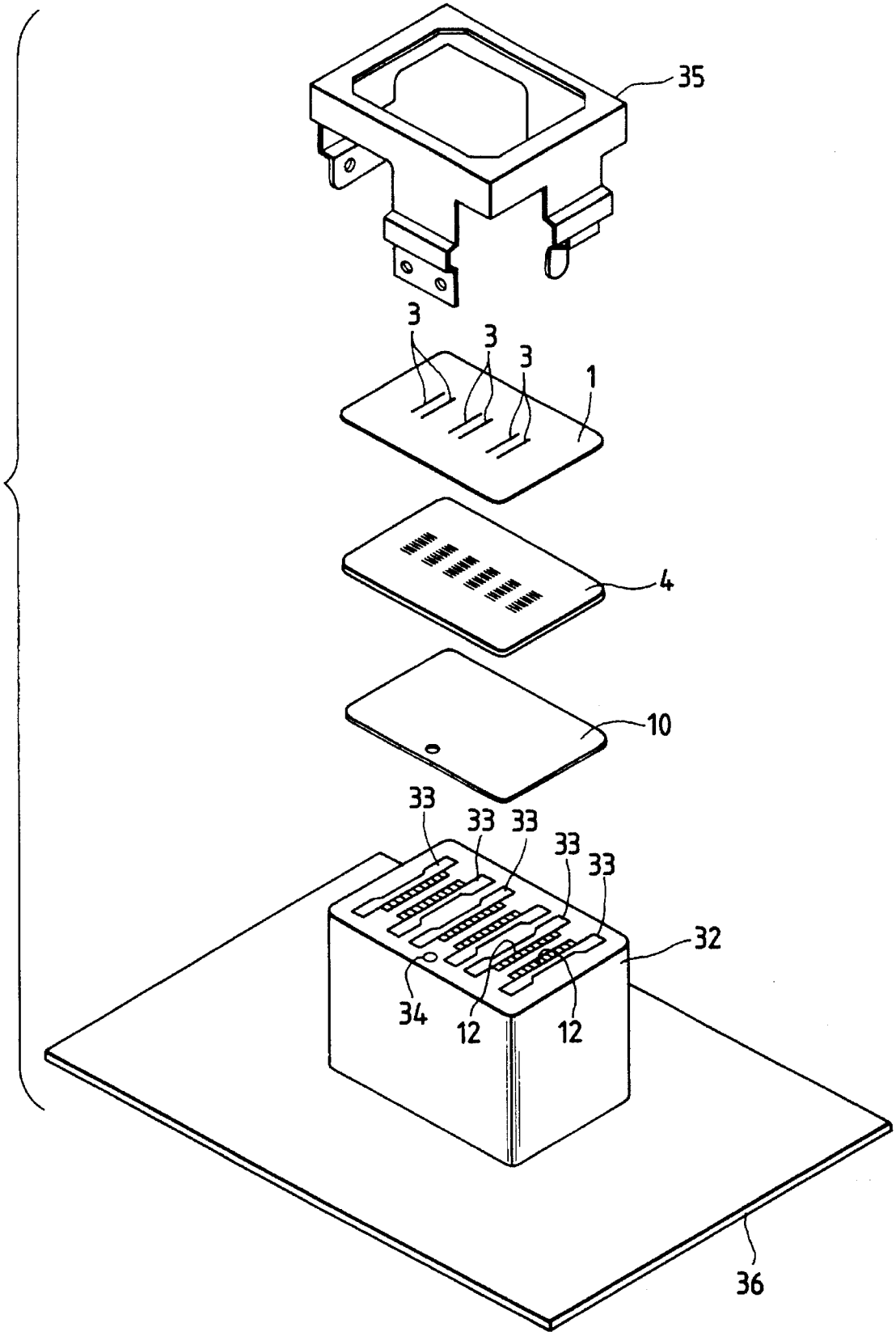
FIG. 1 is an exploded diagram showing an assembly of an exemplary ink jet recording head used in the invention.

Details of the invention will now be described with reference to preferred embodiments shown in the drawings.

Figure 2A:
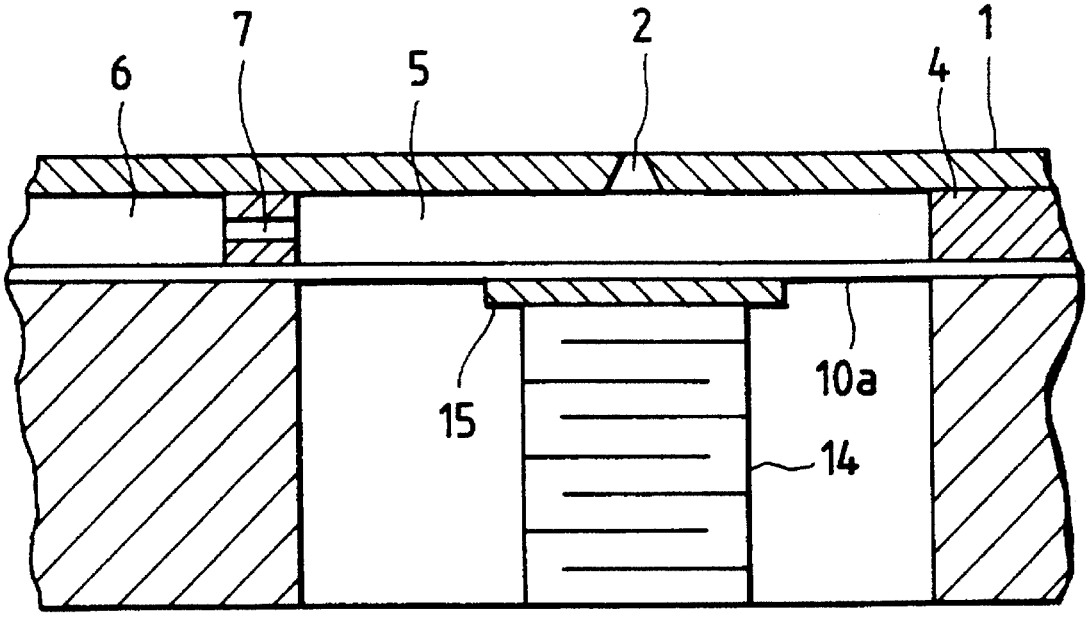
FIGS. 2(*a*) and 2(*b*) are diagrams showing a state in which a piezoelectric vibrating element is contracted and a state in which the piezoelectric vibrating element is expanded in the recording head shown in FIG. 1.
Figure 2B:
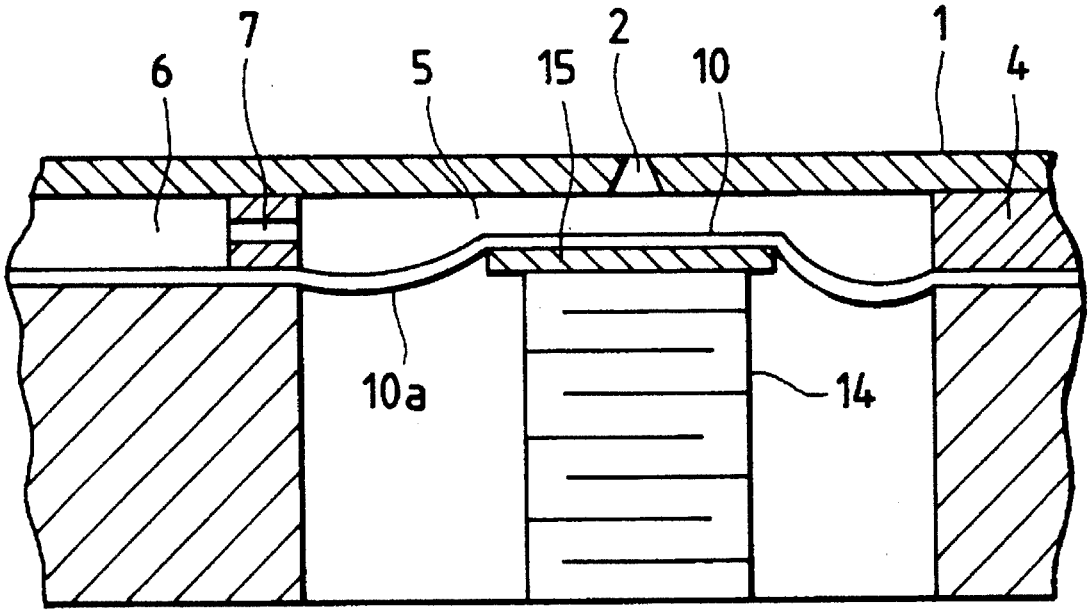

FIG. 1 is an exploded diagram showing an assembly of an exemplary ink jet recording head used in the invention. In FIG. 1, reference numeral 1 designates a nozzle plate having arrays 3 of nozzle openings with the nozzles being formed at a predetermined pitch, e.g., 180 dpi. Each array has nozzle openings 2 (FIG. 2).

Reference numeral 4 designates a spacer interposed between a vibrating plate 10 (described later) and the nozzle plate 1. The spacer 4 defines pressure producing chambers 5 and reservoirs 6 so as to correspond respectively to the arrays of nozzle openings as shown in FIG. 2. Ink supply ports 7 communicating with the pressure producing chambers 5 and the reservoirs 6 are also formed in the spacer 4.

Reference numeral 10 designates the vibrating plate, which forms the pressure producing chambers 5 while confronting the nozzle plate 1 through the spacer 4. The vibrating plate 10 includes island portions 15 and thin portions 10a around the island portions 15. Each island portion 15 has a rigidity such that displacements induced by contraction and expansion can be transmitted to as wide an area as possible by causing the vibrating plate 10 to abut against a distal end of a piezoelectric vibrating element 14 of a piezoelectric vibrating element unit 12 (described later) as shown in FIG. 2. As a result of this construction, the pressure producing chamber 5 can be contracted and expanded efficiently in response to the contraction and expansion of the corresponding piezoelectric vibrating element 14.

Figure 3:
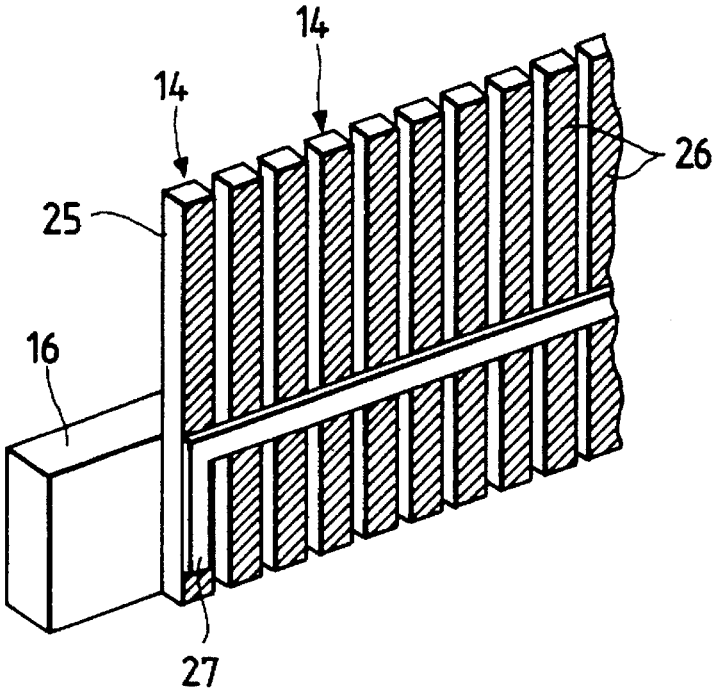
FIG. 3 is a diagram showing an exemplary piezoelectric vibrating element unit used in the recording head shown in FIG. 1.

As shown in FIG. 3, each piezoelectric vibrating element unit 12 includes half of the piezoelectric vibrating elements 14. The piezoelectric vibrating element unit 12 is fixed on a fixed plate 16 with the piezoelectric vibrating elements 14 being arranged at a predetermined pitch. The piezoelectric vibrating elements 14 vibrate in a vertical vibrating mode.

Figure 4:
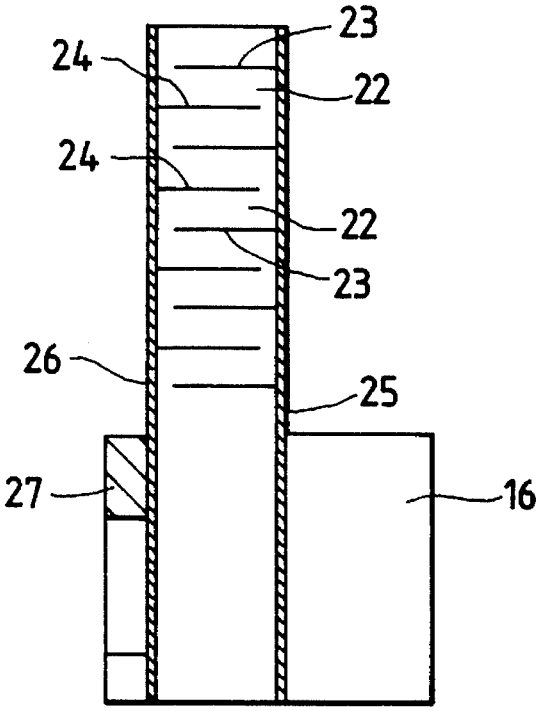
FIG. 4 is a diagram showing an exemplary piezoelectric vibrating element constituting the piezoelectric vibrating element unit.
Figure 5A:
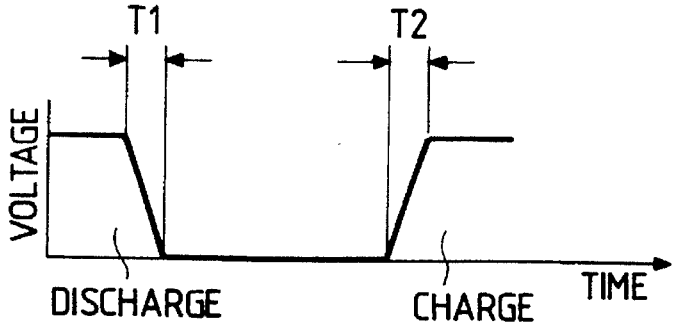
FIGS. 5(*a*) and 5(*b*) are diagrams showing a drive voltage signal shorter than the natural vibration cycle of a piezoelectric vibrating element and a displacement of the piezoelectric vibrating element brought about thereby, and FIGS. 5(*c*) and 5(*d*) are diagrams showing a drive voltage signal longer than the natural vibration cycle of the piezoelectric vibrating element and a displacement of the piezoelectric vibrating element brought about thereby.
Figure 5B:
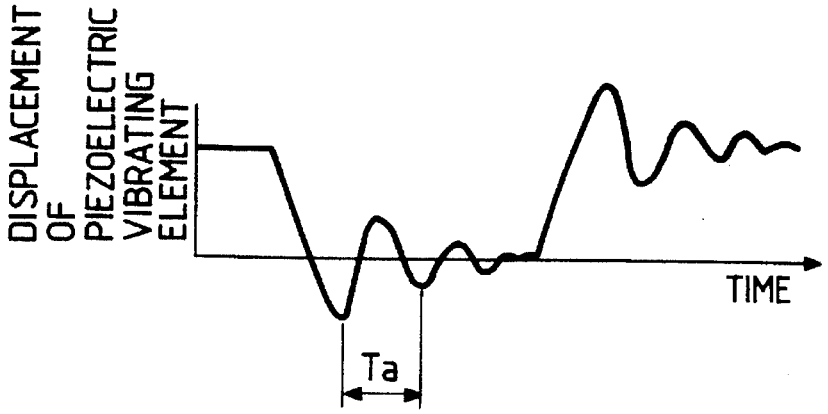
Figure 5C:
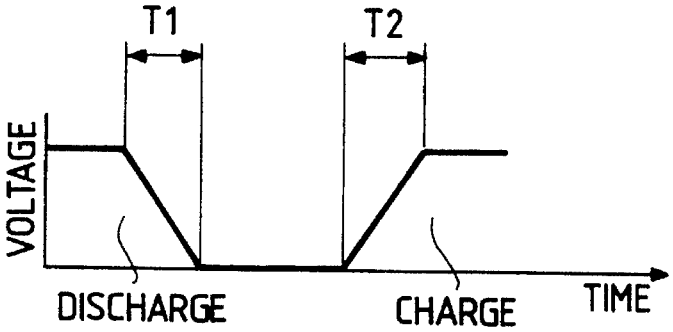
Figure 5D:
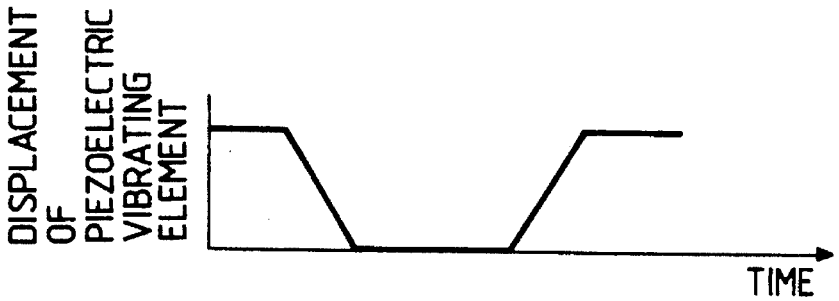

Each vibrating element 14 is, as shown in FIG. 4, arranged so that a plurality of sets, each set composed of a piezoelectric vibrating material 22 interposed between a drive electrode 23 and a common electrode 24, are laminated one upon another in sandwich-like form. The drive electrodes 23 are exposed from a lateral side of the piezoelectric vibrating element 14 and connected in parallel to one another through a drive external electrode 25 formed by, e.g., vapor deposition. The common electrodes 24 are exposed from the other lateral side of the piezoelectric vibrating element 14 and connected in parallel to one another through a common external electrode 26. The common external electrode 26 is connected through an electrically conductive member 27.

Returning to FIG. 1, reference numeral 32 designates a substrate, which has unit accommodating holes 33 and an ink supply port 34 for supplying ink from an ink tank to the ink reservoirs 6. The unit accommodating holes 33 accommodate the vibrating element units 12 so that free ends of the piezoelectric vibrating elements 14 are exposed therefrom. The vibrating plate 10, the spacer 4, and the nozzle plate 1 are aligned on a surface of the substrate 32 and fixed by a frame body 35 to form a recording head body. The frame body 35 serves also as an electrostatic shield. Reference numeral 36 in FIG. 1 designates a base plate for mounting the recording head on a carriage.

In this construction, the vibrating plate 10 is made of a metal plate or a synthetic resin plate so that the vibrating plate 10 can be deformed at a higher efficiency by the displacement of the piezoelectric vibrating element 14. When the piezoelectric vibrating element 14 is expanded (FIG. 2(*b*) to jet an ink droplet under a condition in which the piezoelectric vibrating element 14 is subsequently contracted (FIG. 2(*a*)), then the corresponding pressure producing chamber 5 is compressed in response to the expansion of the piezoelectric vibrating element 14. As a result, the ink pressure in the pressure producing chamber 5 is increased on the order of several atmospheres of pressure substantially instantly to eject the ink present in the pressure producing chamber 5 as an ink droplet. Reference numeral 15 in FIG. 2 designates the island portion for transmitting the displacement of the piezoelectric vibrating element 14 over a wide area on the vibrating plate 10.

It is known that when a piezoelectric vibrating element 14 that vibrates vertically is charged at a cycle T1 that is shorter than a natural vibration cycle Ta thereof or discharged at a cycle T2 that is also shorter than the natural vibration cycle Ta (FIG. 5(*a*)), the piezoelectric vibrating element itself generates a residual vibration at the natural vibration cycle Ta after the charging or discharging has been completed, as shown in FIG. 5(*b*). When the residual vibration of the piezoelectric vibrating element is transmitted to the ink in the pressure producing chamber through the vibrating plate 10, the meniscus of the corresponding nozzle opening 2 starts vibrating in an extremely unstable manner due to the very short cycle of the residual vibration, and when the meniscus reaches a predetermined position, it becomes extremely difficult for the piezoelectric vibrating element to vibrate with satisfactory repetitiveness. If, while the meniscus is vibrating, the piezoelectric vibrating element is caused to expand to produce ink droplets, ink droplets are ejected without fail, but dots to be formed on the recording paper by such ink droplets are subjected to variations due to variations in the size and ejection speed of the ink droplets in dependence on the position of the meniscus.

In contradistinction thereto, in accordance with the invention, the charging cycle T1 as well as the discharging cycle T2 of the piezoelectric vibrating element 14 are set to intervals longer than the natural vibration cycle Ta thereof. If the piezoelectric vibrating element 14 is charged or discharged under these conditions (FIG. 5(*c*)), the piezoelectric vibrating element 14 is displaced and expands as directed by a drive waveform without causing residual vibration, as shown in FIG. 5(*d*). In this case, the meniscus produces regular vibrations of a cycle longer than the natural vibration cycle of the piezoelectric vibrating element 14. Therefore, it is possible to set the charging and the discharging cycles to intervals longer than the natural vibration cycle Ta, i.e., the rise time T1 and the fall time T2 are set to intervals longer than the natural vibration cycle Ta of the piezoelectric vibrating element 14, and it is also possible to set the piezoelectric vibrating element 14 drive timing for jetting an ink droplet by taking into account the displacement derived from the vibration of the meniscus. As a result, stable ink droplets can be produced while the meniscus is vibrating.

Figure 6:
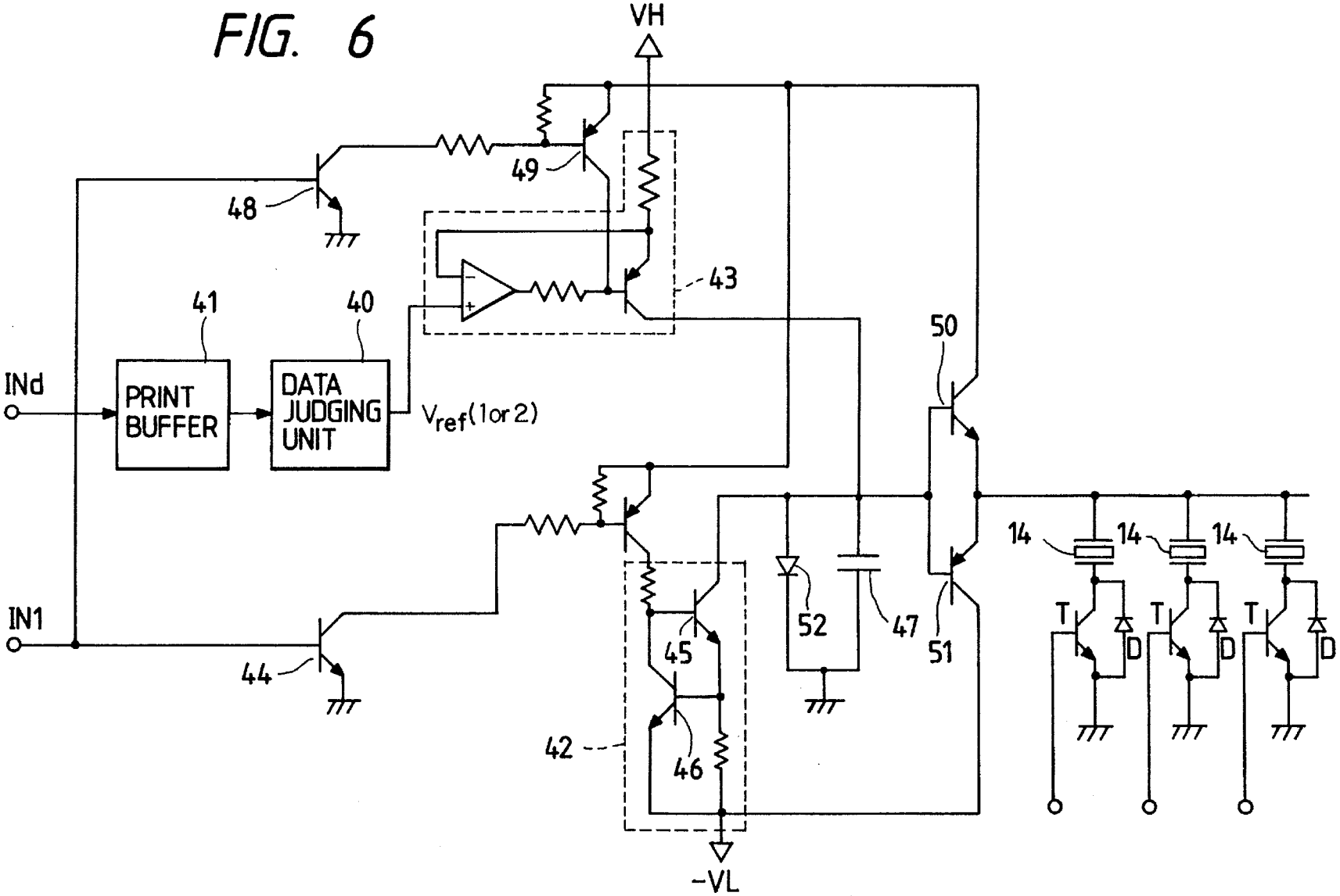
FIG. 6 is a block diagram showing an exemplary drive circuit for driving the recording head shown in FIG. 1.
Figure 7A:
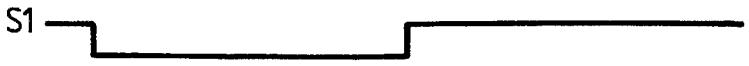
FIGS. 7(*a*), 7(*b*), 7(*c*) and 7(*d*) are diagrams showing operations of the drive circuit of the invention, in which FIG. 7(*a*) shows a print auxiliary signal.
Figure 7B:
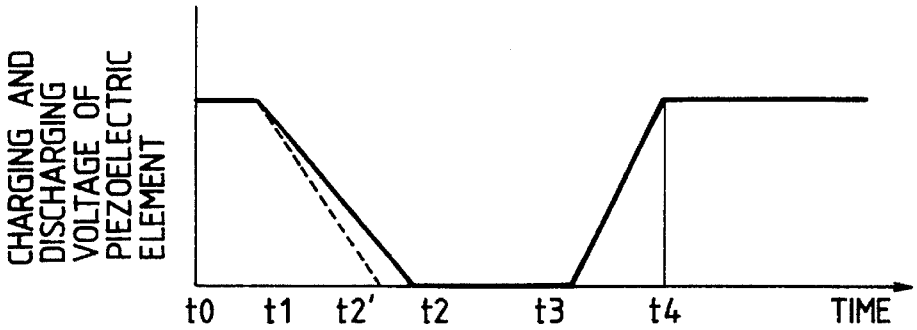
Figure 7C:
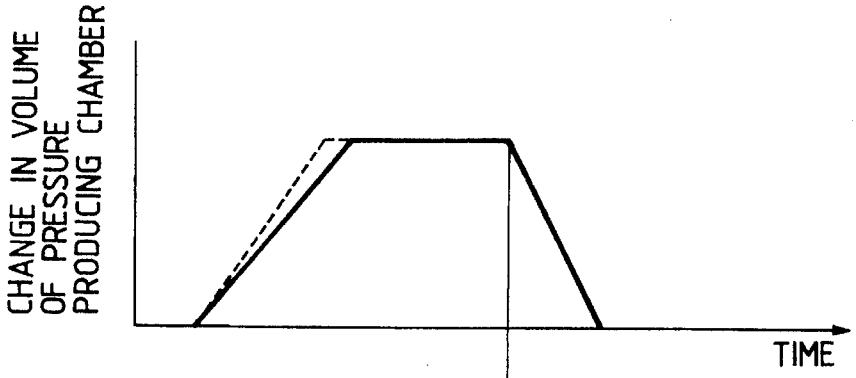
Figure 7D:
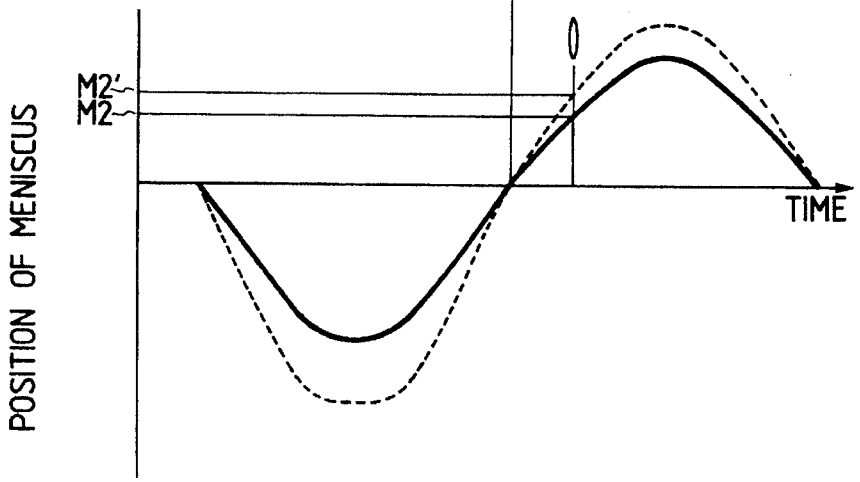

FIG. 6 shows an exemplary circuit for driving the ink jet recording head. In FIG. 6, reference numeral IN1 designates an input terminal which receives a print auxiliary signal S1 for generating a drive voltage that causes the pressure producing chamber 5 of the recording head to contract (which is the standby state) or causes the pressure producing chamber 5 to expand (which is the state in which ink is sucked into the chamber 5), and INd designates a data input terminal for receiving data from a host apparatus.

Reference numeral 40 designates a text/graphics data judging unit, which judges whether data inputted to a print buffer 41 from the terminal INd is text data or graphics image data based on the inputted data, and outputs a reference voltage Vref to a variable time constant adjusting unit 43 (described later) in accordance with the result of the judgment. Reference numeral 43 designates the variable time constant adjusting unit, which adjusts the pressure producing chamber 5 expansion speed. The variable time constant adjusting unit 43 adjusts the time constant by the reference voltage Vref from the data judging means 40. In the case where the print data includes only text data, a reference voltage Vref1 is inputted, which sets a first time constant that is longer than the natural vibration cycle of the piezoelectric vibrating element 14, whereas in the case where the print data includes only graphics image data, a reference voltage Vref2 is inputted, which sets a second time constant that is longer than the first time constant. Reference numeral 42 designates a fixed time constant adjusting unit for setting a pressure producing chamber 5 contracting speed, which is set so as to yield a contraction interval longer than the natural vibration cycle of the piezoelectric vibrating element 14.

Reference numeral 44 designates a switching transistor whose base is connected to the input terminal IN1. The switching transistor 44 controls the operation of the fixed time constant adjusting unit 42 with the print auxiliary signal S1 inputted to the terminal IN1 in synchronism with a print timing signal. The fixed time constant adjusting unit 42 is activated when the transistor 44 is turned on, and generates a voltage waveform for causing the piezoelectric vibrating element 14 to expand at a time constant determined by a circuit constant to thereby bring the pressure producing chamber 5 into the contracting state, which is the standby state.

Reference numeral 48 designates a switching transistor whose base is connected to the terminal IN1. This switching transistor 48 operates the variable time constant adjusting unit 43 by turning a transistor 49 off when the fixed time constant adjusting unit 42 is inoperative. The variable time constant adjusting unit 43 generates a voltage waveform for causing the piezoelectric vibrating element 14 to contract at a time constant determined by a circuit constant to thereby expand the pressure producing chamber 5. In FIG. 6, reference numerals 50 and 51 designate current amplifying transistors.

The respective piezoelectric vibrating elements 14 have first terminals thereof connected to the current amplifying transistors 50 and 51, and the second terminals thereof grounded through transistors T that are to be turned on by print signals. A diode D is inserted to connect the collector and the emitter of each transistor.

Since the voltage level of the print auxiliary signal S1 to be inputted to the terminal IN1 is initially high, the fixed time constant adjusting means 42 is operative, and therefore the commonly connecting terminal side of the piezoelectric vibrating element 14 is maintained at a negative potential of substantially −VL (volts). As a result, all the piezoelectric vibrating elements 14 are charged through the diodes D so that these elements are caused to expand, thus keeping the pressure producing chambers 5 contracted.

When the print auxiliary signal S1 goes low, only the piezoelectric vibrating element 14 connected to the transistor T that has been turned on by the print signal is discharged through the transistor T.

The operation of the thus-constructed drive voltage signal generating circuit will be described based on the diagram shown in FIG. 7.

Upon input of print data from the host apparatus to the print buffer 41, the print data judging unit 40 checks if the print data includes graphics image data. Assume the print data includes only text data in this case, such that the print data judging unit 40 outputs the reference voltage Vrefl for text data.

When the recording head moves by a unit distance under this condition, a print timing signal for forming a single dot is generated at a time t1 by a printer body (not shown), and in synchronism therewith, the print auxiliary signal S1 that has been high goes low and is received by the terminal IN1. Then, the transistor 44 is turned off to inhibit the operation of the fixed time constant adjusting unit 42. At the same time, the transistor 48 and also the transistor 49 are turned off to operate the variable time constant adjusting unit 43. As a result, the terminal voltage of a capacitor 47 is increased to 0 (volt) from substantially −VL (volts) by the reference voltage Vrefl at a rate determined by the first time constant defined by the circuit constant, thus to generate the drive voltage from the current amplifying transistors 50 and 51.

In association with the above operation, charges stored in the piezoelectric vibrating elements 14 connected to the transistors T that have been turned on by the print signals at an interval between times t1 and t2' are discharged through the transistors T (FIG. 7(*b*)). This causes the piezoelectric vibrating elements 14 to contract, thereby causing the corresponding pressure producing chambers 5 to expand (FIG. 7(*c*)). The expansion of the pressure producing chambers 5 introduces ink into the pressure producing chambers 5 from the reservoirs 6 through the ink supply ports 7, and at the same time causes the meniscuses of the corresponding nozzle openings 2 to retreat toward the pressure producing chambers 5.

When the terminal voltage of the capacitor 47 is substantially zeroed at time t2', the increase in the terminal voltage is blocked by a diode 52. The drive voltage is thereafter maintained at a fixed level of substantially 0 (volt) until the print auxiliary signal S1 that has been low goes high.

Here, since the first time constant, i.e., the interval between times t1 and t2', is set to an interval longer than the natural vibration cycle of the piezoelectric vibrating element 14, the piezoelectric vibrating element 14 stops without undergoing a damped oscillator motion, thereby stopping the volumetric change of the pressure producing chamber 5. On the other hand, the meniscus formed adjacent to the nozzle opening 2 vibrates at a vibration cycle defined by a flow path system irrespective of the displacement of the piezoelectric vibrating element 14, thus changing the position thereof with time (FIG. 7(*d*)).

When the print auxiliary signal S1 goes high at a time (time t3) after the elapse of a predetermined time in this way, the operation of the variable time constant adjusting unit 43 is inhibited, and the fixed time constant adjusting unit 42 starts operating instead. Therefore, the terminal voltage of the capacitor 47 drastically drops to −VL (volts) again, thus generating a similar drive voltage through the current amplifying transistors 50 and 51.

As a result, the piezoelectric vibrating elements 14 that have been discharged by the print signals in the above-mentioned operation are suddenly charged and expanded through the diodes D with the common connecting terminal side thereof as the negative potential (FIG. 7(*b*)). Accordingly, the pressure producing chambers 5 are caused to contract jet ink droplets from the corresponding nozzle openings 2 and form dots on the recording paper.

The above operation is repeated so that a dot is formed on the recording paper every time a print timing signal is generated as the recording head moves.

On the other hand, if image data is included in the print data outputted from the host apparatus, the print data judging unit 40 outputs to the variable time constant adjusting unit 43 the reference voltage signal Vref2 for setting the second time constant, which is longer than the first time constant.

When the recording head moves by the unit distance under this condition, the print timing signal for forming a single dot is similarly generated at time t1 from the printer body (not shown), and in synchronism therewith, the print auxiliary signal S1 that has been high goes low and is inputted to the terminal IN1.

As a result, the transistor 44 turns off to inhibit the operation of the fixed time constant adjusting unit 42, and simultaneously therewith, the transistor 48 and the transistor 49 turn off to operate the variable time constant adjusting unit 43. This operation of the variable time constant adjusting unit 43 increases the terminal voltage of the capacitor 47 to 0 (volt) from substantially −VL (volts) at the second time constant that is longer than the first time constant defined by the circuit constant, so that a drive voltage is generated by the current amplifying transistors 50 and 51.

In association therewith, the piezoelectric vibrating elements 14 connected to the transistors T that have been turned on by the print signals at an interval between times t1 and t2 are discharged through the transistors T (FIG. 7(*b*)). Accordingly, the piezoelectric vibrating elements 14 contract, whereas the pressure producing chambers 5 expand (FIG. 7(*c*)). The expansion of the pressure producing chambers 5 introduces ink to the pressure producing chambers 5 through the ink supply ports 7 from the reservoirs 6, and at the same time, the meniscuses of the nozzle openings 2 retreat toward the pressure producing chambers 5 (FIG. 7(*d*)).

When the terminal voltage of the capacitor 47 drops to substantially 0 (volt) at time t2, the diode 52 blocks the increase in the terminal voltage, so that the drive voltage is thereafter maintained at a fixed level of substantially 0 (volt) until the print auxiliary signal S1 goes high from low.

Since the second time constant, i.e., the interval between times t1 and t2, is set to an interval that is longer than the natural vibration cycle of the piezoelectric vibrating element 14, the piezoelectric vibrating element 14 stops without undergoing oscillatory damping, whereas the volumetric change of the pressure producing chamber 5 is also stopped. In contrast thereto, the meniscus formed adjacent to the nozzle opening 2 vibrates at a vibrating cycle defined by the flow path system irrespective of the displacement of the piezoelectric vibrating element 14, thus changing the position thereof with time (FIG. 7(*d*)).

When the print auxiliary signal S1 goes high at a time (time t3) after the elapse of a predetermined time period in this way, the operation of the variable time constant adjusting unit 43 is stopped, whereas the operation of the fixed time constant adjusting unit 42 is started. As a result, the terminal voltage of the capacitor 47 rapidly drops to −VL (volts) again, and a similar drive voltage is generated through the current amplifying transistors 50 and 51.

The piezoelectric vibrating elements 14 that are discharged by the print signals in the above operation expand while charged through the diodes D with the common connecting terminal side as the negative potential (FIG. 7(*b*)). Accordingly, the pressure producing chambers 5 contract, which causes ink droplets to be jetted from the corresponding nozzle openings 2 to form dots on the recording paper.

The above operation is repeated so that a dot is formed on the recording paper every time a print timing signal is generated as the recording head moves.

In this manner, since the pressure producing chamber 5 expansion speed changes based on the result of the judgment made by the data judging unit 40, the vibration cycle and phase of the meniscus formed adjacent to the corresponding nozzle opening 2 remains unchanged as shown in FIG. 7(*d*)), but the maximum displacement of the meniscus is changed. As a result, the position of the meniscus at the time of jetting an ink droplet is displaced to M2' in the case of printing text data, and to M2 in the case of printing image data. Since M2'>M2, the volume of a ejecting ink droplet becomes larger in the case of printing text data.

On the other hand, since the piezoelectric vibrating element 14 expands at a fixed speed, the pressure producing chamber 5 contracting speed is also fixed. Therefore, no change takes place in the ink droplet ejection speed irrespective of the volume of the ink droplet. This means that the ink droplet is onto a single point on the recording paper irrespective of the volume thereof, thus achieving printing with an amount of ink corresponding to the print data without impairing the print quality.

Figure 8:
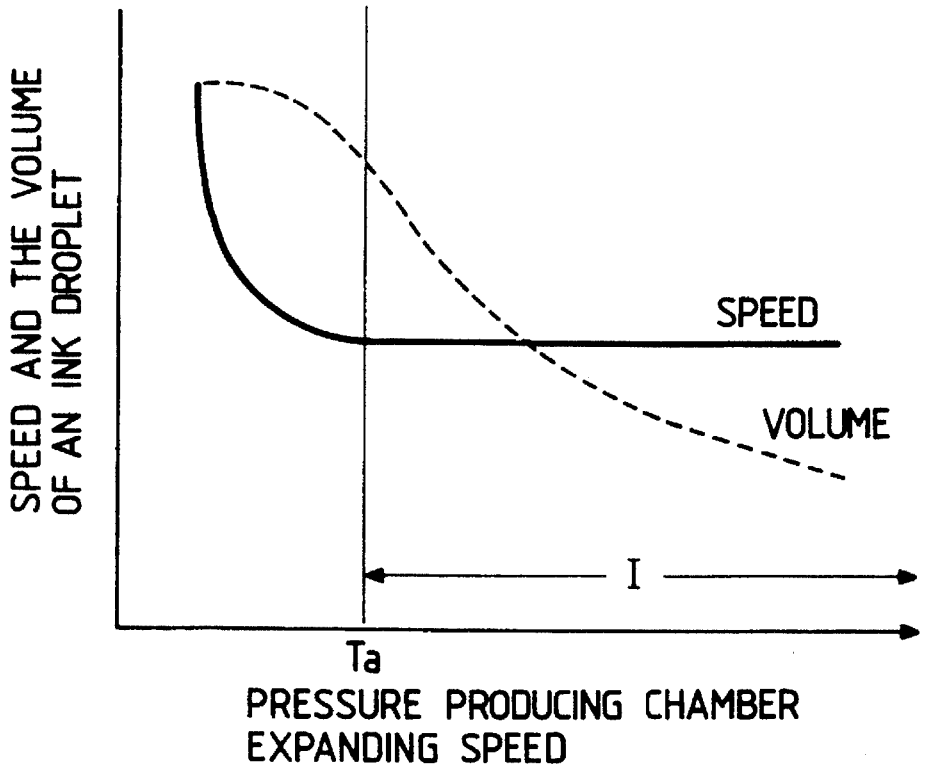
FIG. 8 is a diagram showing a relationship between the size of an ink droplet and the ink droplet ejection speed defined by the drive circuit.

FIG. 8 shows the relationship between the pressure producing chamber 5 expansion speed and the volume of an ink droplet (the curve indicated by a broken line), and the relationship between the pressure producing chamber 5 expansion speed and the ink droplet ejection speed (a curve indicated by a solid line). This figure shows that when the pressure producing chamber 5 is caused to expand at a cycle longer than the natural vibration cycle of the piezoelectric vibrating element 14, the ink droplet ejection speed remains at a fixed level irrespective of the volume thereof, even though the o volume thereof increases with increasing pressure producing chamber 5 expansion speed.

FIG. 9 is a series of photographs indicating the size of an ink droplet as well as the distance thereof from the nozzle opening, i.e., the ink droplet ejection speed. More specifically, the photographs show conditions adjacent to the nozzle opening after the elapse of a predetermined time from the generation of the ink droplet, which is produced by not only changing the piezoelectric vibrating element 14 contracting speed, i.e., the pressure producing chamber 5 expanding time to a level of 20 μsec at intervals of 2 μsec from 8 μsec, but also the expansion of the piezoelectric vibrating element 14 after the elapse of a predetermined time from the time of starting of the contraction of the piezoelectric vibrating element 14.

As is apparent from the photographs, while the size of the ink droplet becomes larger as the expanding time is shortened and the size of the ink droplet becomes smaller as the expanding time is lengthened, the tips of the respective ink droplets are positioned flush with one another. That is, it is demonstrated that the volume of the ink droplet can be adjusted by changing the pressure producing chamber 5 expansion speed without changing the ink droplet ejection speed.

Figure 10:
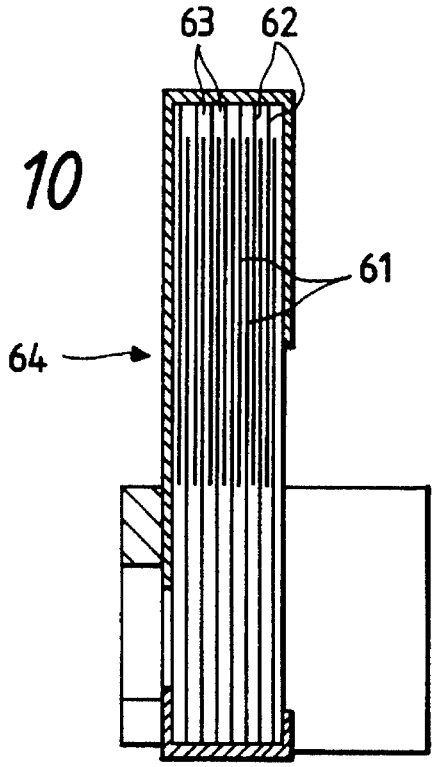
FIG. 10 is a sectional view showing another exemplary piezoelectric vibrating element to which the invention can be applied.

While the case has been described where the invention is applied to a recording head using d33 effect-based piezoelectric vibrating elements in which electrodes are arranged perpendicular to the piezoelectric vibrating element expansion direction, it is apparent that similar effects can be obtained by applying the invention to the driving of a recording head 64 using d31 effect-based piezoelectric vibrating elements 64 in which drive electrodes 61 are arranged with a piezoelectric material 63 interposed therebetween and in which common electrodes 62 are arranged with a piezoelectric material 63 interposed therebetween, both electrodes and piezoelectric materials extending parallel to the expanding direction, as shown in FIG. 10.

Figure 11:
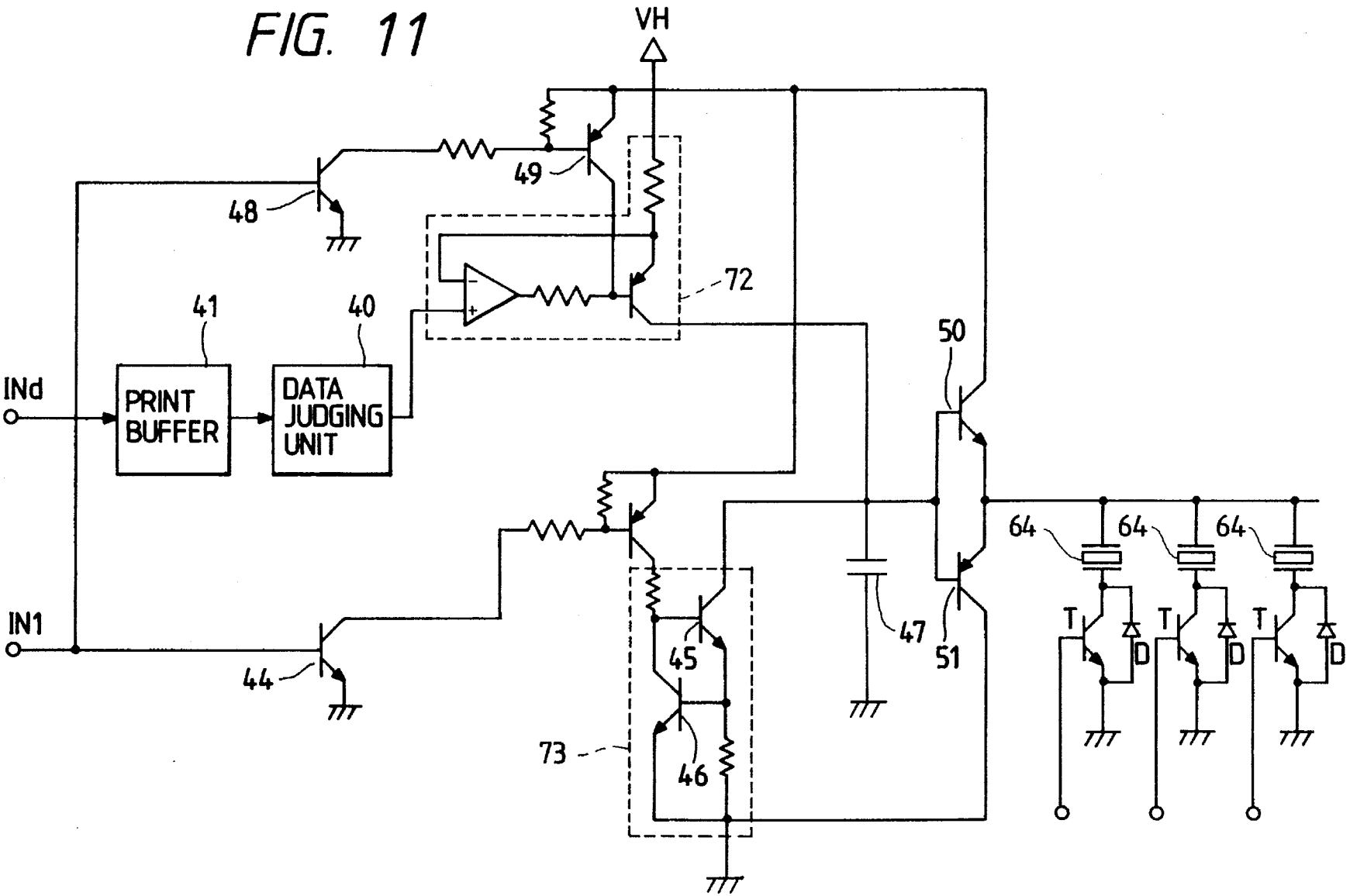
FIG. 11 is a block diagram showing an exemplary drive circuit of the invention which is suitable for driving a recording head using the piezoelectric vibrating element shown in FIG. 10.

That is, in FIG. 11, reference numeral 72 designates a variable time constant adjusting unit for setting the pressure producing chamber expansion speed. If the signal from the data judging unit 40 indicates that the print data includes only text data, the first time constant that is longer than the natural vibration cycle of the piezoelectric vibrating element 64 is set, whereas if the print data includes only graphics image data, the second time constant that is longer than the first time constant is set. Reference numeral 73 designates a fixed time constant adjusting unit for setting the pressure producing chamber contracting speed. The fixed time constant is a time longer than the natural vibration cycle of the piezoelectric vibrating element 64 in this embodiment.

The piezoelectric vibrating elements 64 have first terminals thereof connected to the current amplifying transistors 50 and 51, and the second terminals thereof grounded through the transistors T. A diode D is inserted to connect the emitter and the collector of each transistor T. Since the voltage level of the print auxiliary signal S1 to be inputted to the terminal IN1 is initially high, the fixed time constant adjusting unit 73 is operative, and therefore the common connecting terminal side of the piezoelectric vibrating element 64 is maintained at a fixed level of substantially 0 (volt). As a result, all the piezoelectric vibrating elements 64 are discharged through the diodes D to substantially zero the applied voltage.

Thus, when the print auxiliary signal S1 goes low, only the piezoelectric vibrating element 64 connected to the transistor T that has been turned on by the print signal is lo discharged through the transistor T, thereby causing the corresponding pressure producing chamber 5 to be expanded.

As a result of the above construction, the pressure producing chamber 5 is caused to expand during the time the piezoelectric vibrating element 64 is being charged, whereas the voltage applied to the piezoelectric vibrating element 64 becomes substantially zero during the time the piezoelectric vibrating element 64 is being discharged, so that an ink droplet is jetted when the pressure producing chamber 5 of being contracted. Therefore, by setting the time constant of the variable time constant adjusting unit 72 to a long interval in response to the signal from the data judging unit 40 in the case of printing image data and to a short interval in the case of printing text data, the volume of the ink droplet can be adjusted with the ink droplet ejection speed maintained at a fixed level in a manner similar to that of the above-mentioned embodiment.

The pressure producing chamber expansion speed is set to two levels in the above embodiments. If such speed is adjusted to three or more levels in accordance with the density of an image, a more subtle density adjustment can be given to the image data. That is, if an image has a high dot density, the size of an ink droplet can be adjusted to be smaller, whereas if an image has a low dot density, a dot containing a larger amount of ink is used for the printing. As a result, a uniform density can be maintained over the entire part of the image.

As described in the foregoing, the invention is characterized as adjusting the volume of an ink droplet without changing the ink droplet ejection speed. This operation can be performed by ejection of an ink droplet with the pressure producing chamber in an initial condition expanded to a predetermined volume over a time which is longer than the natural vibration cycle of the piezoelectric vibrating element and which corresponds to the size of the ink droplet to be ejected, by maintaining the pressure producing chamber as expanded for a predetermined interval with the expansion start time as a reference, and then by contracting the pressure producing chamber to the initial condition over a predetermined time that is longer than the natural vibration cycle of the piezoelectric vibrating element in a method for driving an ink jet recording head having not only pressure producing chambers communicating with nozzle openings but also piezoelectric vibrating elements for expanding and contracting the pressure producing chambers. As a result of the above operation, production of wrinkles can be prevented without impairing the print quality by minimizing the wetting of the recording paper at the time of printing image data.

What is claimed is:

1. A method for driving an ink jet recording head having a pressure producing chamber communicating with a nozzle opening and a piezoelectric vibrating element for expanding and contracting the pressure producing chamber, the method comprising the steps of:

expanding the pressure producing chamber under an initial condition to a predetermined volume over a first time period from an expansion start time, the first time period being longer than a natural vibration cycle of the piezoelectric vibrating element and corresponding to a size of an ink droplet to be ejected;

maintaining the pressure producing chamber as expanded for a predetermined second period of time, using the expansion start time as a reference; and then contracting the pressure producing chamber to the initial condition over a predetermined third time period longer than the natural vibration cycle of the piezoelectric vibrating element, so that the ink droplet is ejected.

2. An apparatus for driving an ink jet recording head having a pressure producing chamber communicating with a nozzle opening and a piezoelectric vibrating element for expanding and contracting the pressure producing chamber, the apparatus comprising:

drive voltage signal generating means for cyclically generating a first voltage waveform for expanding the pressure producing chamber under an initial condition to a predetermined volume over a first period of time, the first period of time being longer than a natural vibration cycle of the piezoelectric vibrating element and being suitable for forming a desired size of an ink droplet, a second voltage waveform for maintaining the pressure producing chamber as expanded for a predetermined second period of time with an output start time of the first voltage waveform as a reference, and a third voltage waveform for contracting the pressure producing chamber to the initial condition over a predetermined third period of time longer than the natural vibration cycle of the piezoelectric vibrating element, and for outputting the first, second and third voltage signals as the drive voltage signal; and means for selectively applying the drive voltage signal from the drive voltage signal generating means to the piezoelectric vibrating element; wherein a time period during which the first voltage waveform is produced is varied in accordance with the size of the ink droplet to be ejected.

3. The apparatus for driving an ink jet recording head according to claim 2, wherein the drive voltage signal generating means comprises a charging and discharging circuit comprising a variable time constant adjusting unit and a capacitor, a time for producing the first voltage waveform being adjusted by changing an input to the variable time constant adjusting unit.

4. The apparatus for driving an ink jet recording head according to claim 2, further comprising data judging means for determining whether or not data inputted to a print buffer includes text data or graphics image data, and wherein a time for producing the first voltage waveform is set to a first value when printing text data and to a second value longer in duration than the first value when printing graphics image data, in accordance with a signal from the data judging means.

5. The method according to claim 1, further comprising the step of:

setting the first time period to one of at least two alternative durations, in accordance with a desired size of an ink droplet to be ejected.

* * * * *